US005909771A

United States Patent [19]

Giroux et al.

[11] Patent Number: 5,909,771

[45] Date of Patent: Jun. 8, 1999

[54] WELLBORE VALVE

[75] Inventors: Richard L. Giroux, Katy, Tex.; Peter Budde, KC Vlaardigen, Netherlands

[73] Assignee: Weatherford/Lamb, Inc., Houston, Tex.

[21] Appl. No.: 08/977,466

[22] Filed: Nov. 24, 1997

Related U.S. Application Data

[63] Continuation-in-part of application No. 08/641,009, Apr. 29, 1996, Pat. No. 5,690,177, and application No. 08/868,511, Jun. 4, 1997, Pat. No. 5,804,592, which is a continuation-in-part of application No. 08/639,886, Apr. 29, 1996, Pat. No. 5,680,902, which is a continuation of application No. 08/519,503, Aug. 25, 1995, Pat. No. 5,511,618, which is a continuation of application No. 08/283,404, Aug. 1, 1994, Pat. No. 5,450,903, said application No. 08/641,009, is a continuation of application No. 08/519,503.

[30] Foreign Application Priority Data

Mar. 22, 1994 [GB] United Kingdom ..... 9405679

[51] Int. Cl.[6] ..... E21B 33/13

[52] U.S. Cl. ..... 166/120; 166/155; 166/187; 166/212; 166/242.8

[58] Field of Search ..... 166/120, 208, 166/212, 240, 290, 154–156, 187, 242.8

[56] References Cited

U.S. PATENT DOCUMENTS

| | | | |
|---|---|---|---|
| 1,490,848 | 4/1924 | Pettit | 137/519.5 |
| 1,577,740 | 3/1926 | Macomber et al. | 137/519.5 |
| 1,700,603 | 1/1929 | Vreeland et al. | 137/519.5 |
| 1,863,613 | 6/1932 | Burt . | |
| 1,872,855 | 8/1932 | Walker | 166/153 |
| 1,875,414 | 9/1932 | Burt . | |
| 1,882,314 | 10/1932 | Burt | 166/328 |
| 1,906,312 | 5/1933 | Burt | 137/533.11 |
| 1,984,107 | 12/1934 | Baker | 137/69 |
| 2,075,882 | 4/1937 | Brantly | 166/21 |

(List continued on next page.)

FOREIGN PATENT DOCUMENTS

86/00674 of 1985 WIPO .

OTHER PUBLICATIONS

Valve Seal Floating Equipment, Halliburton, 1996.
Weatherford, "Cementing Program," 1986.
Weatherford, "General Services And Products Catalog," 1990–91.
Weatherford. "AF—SURE—SEAL Technical Bulletin HOU, 123–001," 1986.
Weatherford, "Model 820 Float Valves Technical Bulletin HOU 115–001," 1984.
Weatherford, "Model 457 Float Valves Technical Bulletin HOU 114–001," 1984.
Davis–Lynch, Inc. "In Floating And Cementing Equipment," 1984–85.
Baker Packers, "Bakerline Float Equipment & Cementing Aids," 1989.

(List continued on next page.)

*Primary Examiner*—Roger Schoeppel
*Attorney, Agent, or Firm*—Guy McClung

[57] ABSTRACT

A new fill valve for use in cementing operations in a wellbore extending down into the earth has been invented, the fill valve having a tubular housing having a valve seat, a valve member slidably mounted in said tubular housing, a spring for biasing said valve member towards a closed position, the valve member having a head engageable with the valve seat of the tubular housing to close the valve, selectively releasable apparatus for releasably maintaining the fill valve in an open position, the selectively releasable apparatus including a shear ring breakable in response to pressure thereon, a slider movably disposed in a slider housing mounted in the tubular housing, a lower end of the slider initially projecting down and out from the slider housing and abutting a top end of the valve member and preventing the valve member from moving, a top end of the slider abutting the shear ring, the slider prevented initially from moving by the shear ring, the slider movable in response to pressure of fluid in the wellbore.

9 Claims, 14 Drawing Sheets

U.S. PATENT DOCUMENTS

| | | | |
|---|---|---|---|
| 2,082,482 | 8/1937 | Arnhold . | |
| 2,104,270 | 1/1938 | Owsley | 166/1 |
| 2,162,261 | 6/1939 | Layne | 166/21 |
| 2,309,839 | 2/1943 | Gardner | 137/519.5 |
| 2,320,670 | 6/1943 | Scaramucci | 166/328 |
| 2,627,314 | 2/1953 | Baker et al. | 166/1 |
| 2,630,179 | 3/1953 | Brown | 166/14 |
| 2,654,435 | 10/1953 | Oliver | 166/4 |
| 2,724,443 | 11/1955 | Baker . | |
| 2,748,873 | 6/1956 | Baker et al. | 166/327 X |
| 2,756,828 | 7/1956 | Daily | 166/164 |
| 2,884,938 | 5/1959 | Hildebrandt | 137/68 |
| 2,935,131 | 5/1960 | McCune | 166/45 |
| 3,006,415 | 10/1961 | Burns et al. | 166/156 |
| 3,062,296 | 11/1962 | Brown | 166/225 |
| 3,102,595 | 9/1963 | Fisher et al. | 166/156 |
| 3,105,378 | 10/1963 | Darling | 73/40.5 |
| 3,153,451 | 10/1964 | Chancellor et al. | 166/51 |
| 3,159,219 | 12/1964 | Scott | 166/156 |
| 3,273,650 | 9/1966 | Alexander et al. | 166/327 X |
| 3,332,499 | 7/1967 | Harris et al. | 166/242 |
| 3,385,370 | 5/1968 | Knox et al. | 166/225 |
| 3,385,372 | 5/1968 | Knox | 166/225 |
| 3,545,543 | 12/1970 | Kammerer, Jr. et al. | 166/212 |
| 3,581,817 | 6/1971 | Kammerer, Jr. | 166/208 |
| 3,759,281 | 9/1973 | Falcuta | 137/519.5 |
| 3,768,556 | 10/1973 | Baker | 166/154 |
| 3,770,001 | 11/1973 | Davis | 137/533.11 |
| 3,776,250 | 12/1973 | Knox | 137/71 |
| 3,776,258 | 12/1973 | Dockins, Jr. | 137/519.5 |
| 3,965,980 | 6/1976 | Williamson . | |
| 3,967,680 | 7/1976 | Jeter | 166/325 X |
| 4,060,131 | 11/1977 | Kenneday et al. | 166/156 X |
| 4,067,358 | 1/1978 | Streich | 137/624.13 |
| 4,082,104 | 4/1978 | Keeney | 137/71 |
| 4,096,913 | 6/1978 | Kenneday et al. | 166/208 X |
| 4,311,194 | 1/1982 | White | 166/208 X |
| 4,413,682 | 11/1983 | Callihan et al. | 166/382 |
| 4,429,746 | 2/1984 | Allard | 166/291 |
| 4,442,894 | 4/1984 | Callihan et al. | 166/328 X |
| 4,474,241 | 10/1984 | Freeman | 166/317 |
| 4,487,263 | 12/1984 | Jani | 166/289 |
| 4,488,566 | 12/1984 | Hicks | 137/74 |
| 4,515,218 | 5/1985 | Bissonnette | 166/328 |
| 4,589,495 | 5/1986 | Langer et al | 166/383 |
| 4,603,710 | 8/1986 | Tiefenthaler | 137/514.7 |
| 4,624,316 | 11/1986 | Baldridge et al. | 166/325 |
| 4,625,755 | 12/1986 | Reddoch | 166/325 X |
| 4,625,762 | 12/1986 | Hasazdeh et al. | 137/624.27 |
| 4,655,247 | 4/1987 | Westra et al. | 137/519.5 |
| 4,674,569 | 6/1987 | Revils et al. | 166/154 |
| 4,687,019 | 8/1987 | Mayfield | 137/375 |
| 4,711,300 | 12/1987 | Wardlaw, III et al. | 166/153 |
| 4,712,619 | 12/1987 | Stepp et al. | 166/327 |
| 4,825,947 | 5/1989 | Mikolajczyk | 166/241 |
| 4,872,510 | 10/1989 | Lehr et al. | 166/327 |
| 4,936,397 | 6/1990 | McDonald et al. | 175/26 |
| 4,945,947 | 8/1990 | Westra | 137/519.5 |
| 4,955,949 | 9/1990 | Bailey et al. | 166/325 X |
| 4,962,819 | 10/1990 | Bailey et al. | 166/325 X |
| 4,979,562 | 12/1990 | Langer | 166/242 |
| 5,092,406 | 3/1992 | McStravick | 166/321 |
| 5,178,184 | 1/1993 | Skillman | 137/533.13 |
| 5,228,518 | 7/1993 | Wilson et al. | 166/369 |
| 5,261,488 | 11/1993 | Gullet et al. | 166/241.7 |
| 5,641,021 | 6/1997 | Murray et al. | 166/291 |
| 5,697,442 | 12/1997 | Baldridge | 166/286 |
| 5,718,287 | 2/1998 | Streich et al. | 166/66.6 |
| 5,722,491 | 3/1998 | Sullway et al. | 166/291 |
| 5,738,171 | 4/1998 | Szarka | 166/289 |
| 5,762,139 | 6/1998 | Sullaway et al. | 166/291 |
| 5,765,641 | 6/1998 | Shy et al. | 166/292 |

OTHER PUBLICATIONS

Trico Industries, Inc. "1982–1983 Catalog," 1982.

Baker Oil Tools, "Primary Cementing," 1989.

Baker Oil Tools, Inc., "Bakerline Stage And Stab–In Cementing Equipment And Services," 1982.

Int'l Search Report; Int'l Appln. PCT/EP95/00987 (counterpart of present application 08/519,503).

"1982–83 Products & Services Catalog," Weatherford Int'l, pp. 39–43.

"Float Equipment by Weatherford," Weatherford Oil Tool Co.,Ltd.

"Used Float Shoe Recovered And Tested," Colvard, Feb. 10, 1986 Oil & Gas Journal.

"Flow Loop Endurance Tests Compare Flaot Performance," Stringfellow, Feb. 10, 1986 Oil & Gas Journal.

"Tests Find hammering, Fluid, Cutting, Erosion Cause Float Shoe Failures," Stringfellow, Jan. 21, 1985 Oil & Gas Journal.

"Product Catalog Oilfield Service Solutions," Weatherford Int'l, paticularly pp. 15–17, 1992.

"Conventioanlized and Specialized Float Equipment," Weatherford Int'l, 1985.

FIG. 12
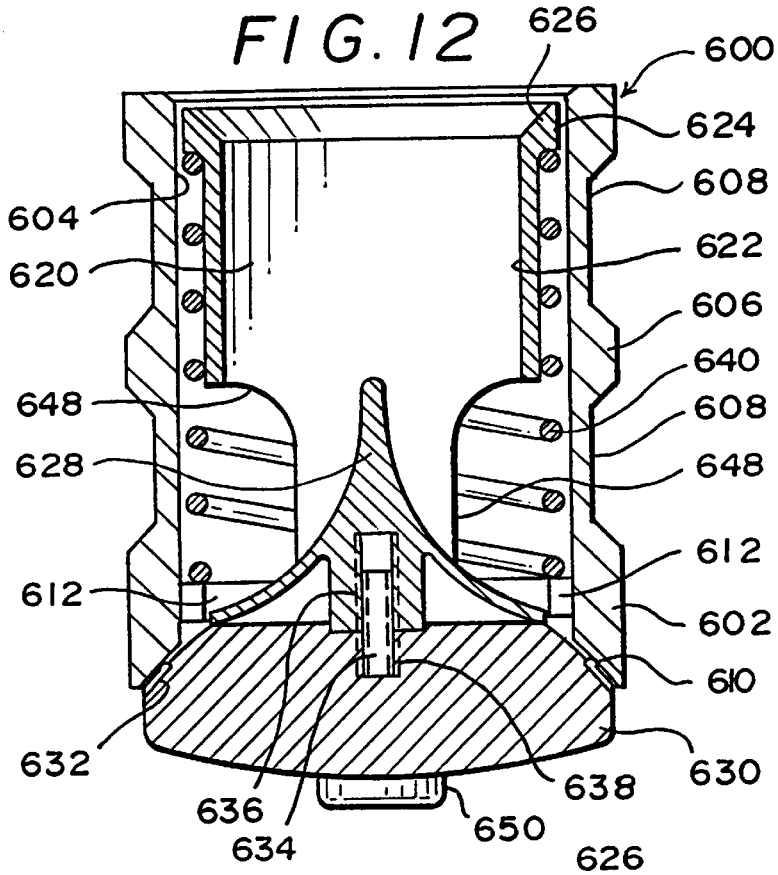
FIG. 13A
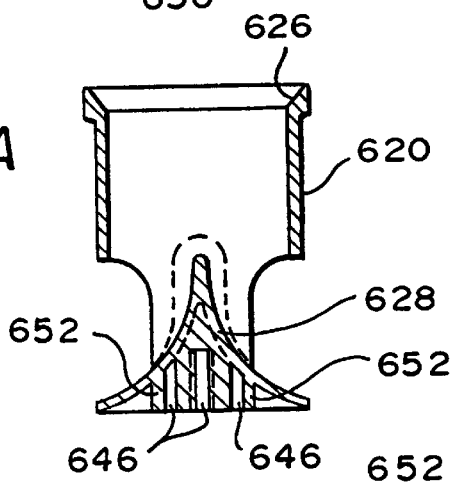
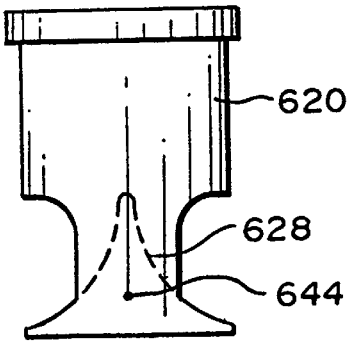
FIG. 13B
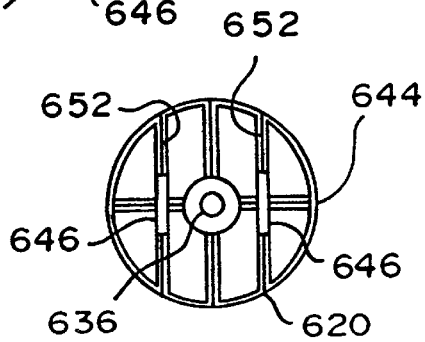
FIG. 13C

FIG. 14A
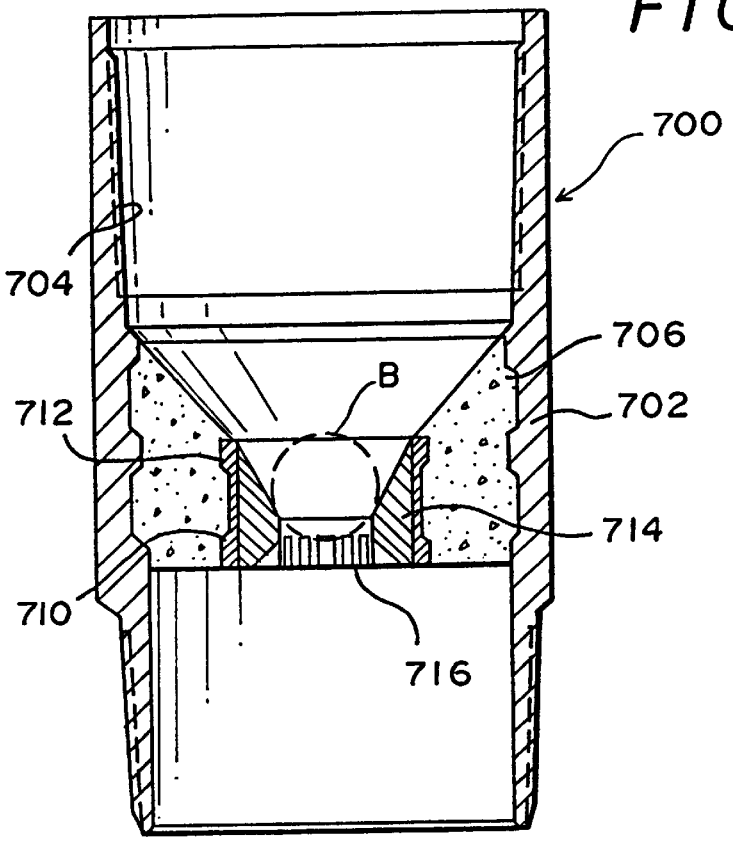
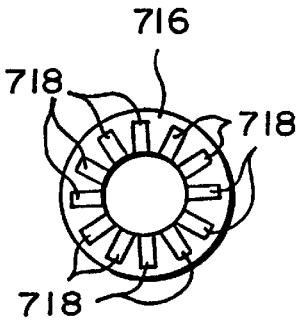
FIG. 14B
FIG. 15B
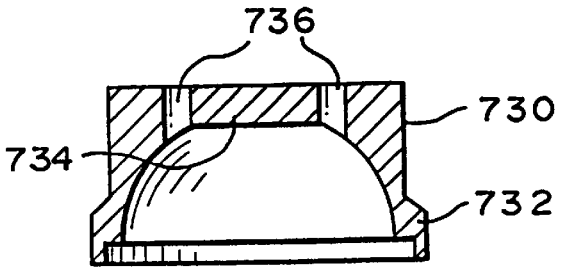
FIG. 15A
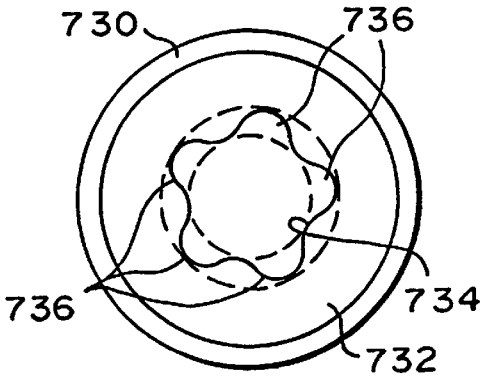

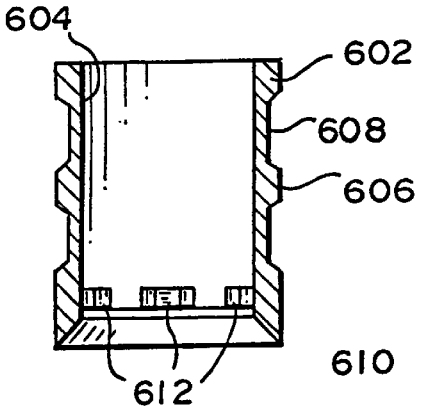
FIG. 16A
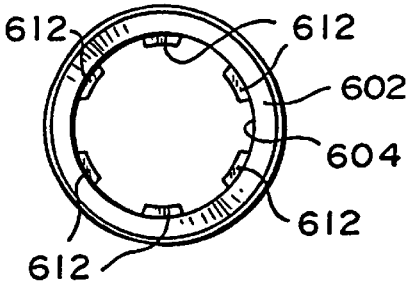
FIG. 16B
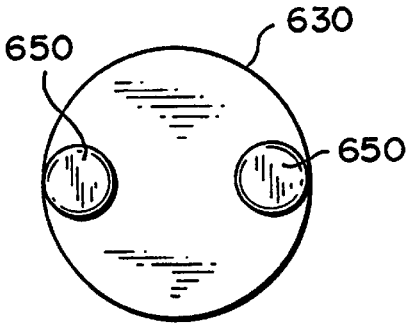
FIG. 17
FIG. 18
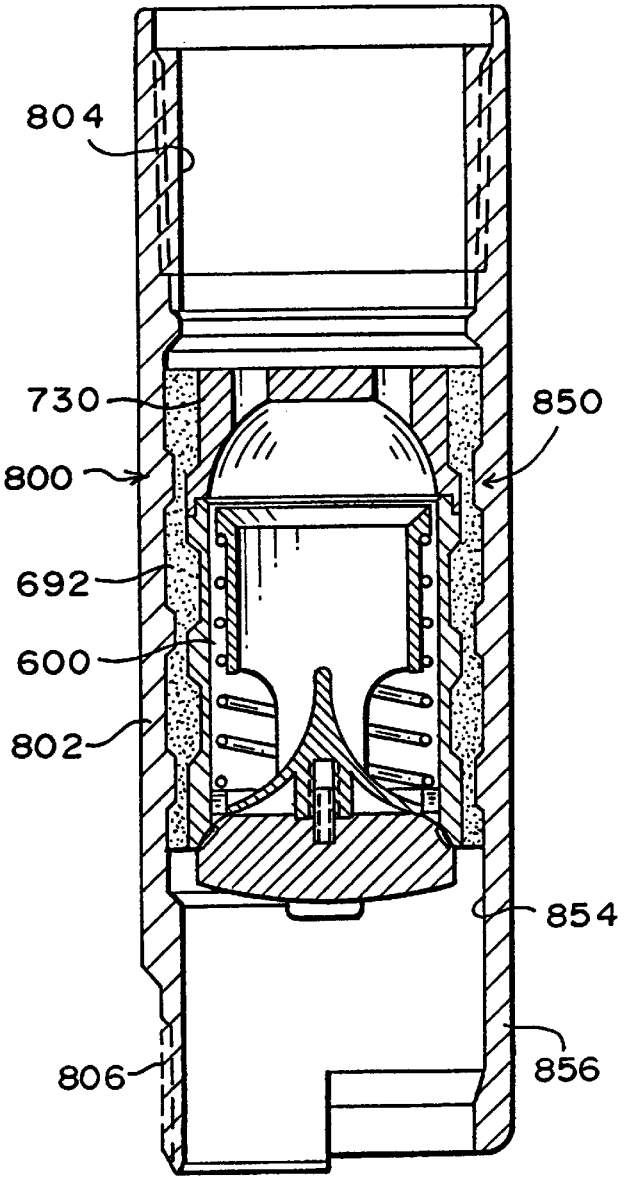

WELLBORE VALVE

RELATED APPLICATIONS

This is a continuation-in-part of U.S. application Ser. No. 08/641,009 filed on Apr. 29, 1996 and issued as U.S. Pat. No. 5,690,177 on Nov. 25, 1997 which is a continuation of U.S. application Ser. No. 08/519,503 filed on Aug. 25, 1995 and issued as U.S. Pat. No. 5,511,618 on Apr. 30, 1996, which is a continuation of U.S. application Ser. No. 08/283,404 filed on Aug. 1, 1994 and issued as U.S. Pat. No. 5,450,903 on Sep. 19, 1995. This is a continuation-in-part of U.S. application Ser. No. 08/868,511 filed Jun. 4, 1997 now U.S. Pat. No. 5,804,592 which is a continuation-in-part of U.S. application Ser. No. 08/639,886 filed Apr. 29, 1996 now U.S. Pat. No. 5,680,902 which is a continuation of U.S. application Ser. No. 08/519,503 filed on Aug. 25, 1995 and issued as U.S. Pat. No. 5,511,618 on Apr. 30, 1996, which is a continuation of U.S. application Ser. No. 08/283,404 filed on Aug. 1, 1994 and issued as U.S. Pat. No. 5,450,903 on Sep. 19, 1995. The disclosures of each of these cited applications and/or patents, all co-owned with the present invention, are incorporated herein for all purposes in their entirety. This application claims priority from United Kingdom Application Ser. No. 9405679 filed on Mar. 22, 1994.

BACKGROUND OF THE INVENTION

This invention relates to a fill valve for use in the construction of oil and gas wells.

FIELD OF THE INVENTION

During the construction of oil and gas wells a borehole is drilled to a certain depth. The drill string is then removed and casing inserted. The annular space between the outside of the casing and the wall of the borehole is then conditioned for cementing by pumping conditioning fluid down the casing. The conditioning fluid flows radially outwardly from the bottom of the casing and passes upwardly through the annular space where it entrains debris and carries it to the surface. Finally, cement is pumped downwardly through the casing, squeezes radially outwardly from the bottom of the casing and passes upwardly into the annular space where it sets.

Conventionally a fill valve is fitted on the bottom of the casing or close to the bottom. The fill valve inhibits fluid entering the casing from the bore but permits fluid to flow from the casing into the borehole. The fill valve is normally incorporated in a float shoe or a float collar, a float shoe being fitted on the bottom of the casing whilst a float collar is incorporated between two lengths of casing.

At the present time certain of applicants' float valves comprises a tubular housing accommodating a valve member which is slidably mounted in the tubular housing. The valve member is generally mushroom shape having a head which is biased upwardly against a valve seat by a spring circumvent the stem of the valve member. Whilst this arrangement works quite acceptably, the rate at which fluid, for example mud, conditioning fluid and cement, can flow through the flow valve is limited by the relatively small flow area between the radial circumference of the head of the valve member and the inside of the tubular housing.

The object of at least preferred embodiments of the present invention is to provide a fill valve which, when open, will allow freer passage of fluids therethrough.

SUMMARY OF THE INVENTION

According to the present invention there is provided a fill valve comprising a tubular housing accommodating a valve member which is biased towards a closed position, characterized in that said valve member comprises a head, a tubular portion and at least one window in said tubular portion, the arrangement being such that, in use, when said fill valve is open, fluid can flow from a casing, through said tubular portion and exit via said at least one window.

Preferably, said tubular portion has at least two windows disposed in the periphery of said tubular portion.

Advantageously, said valve member is provided with a deflector for deflecting fluid entering said tubular portion towards said at least one window.

Preferably, said deflector is designed to inhibit turbulence in the fluid as it passes through the fill valve.

In a particularly preferred embodiment said tubular portion is provided with two windows which are disposed opposite one another and said deflector extends from said head into said tubular portion.

In one embodiment, the head is arranged to seat on the bottom of the tubular housing. In another embodiment the head has a bevelled surface adapted to seat on a correspondingly bevelled valve seat in the tubular housing, optionally with the assistance of a sealing ring.

Conveniently, a coil spring is used to bias the valve member to a closed position. The coil spring may be mounted circumjacent the tubular portion of the valve member and arranged to act between a flange on the tubular portion of the valve member and a shoulder formed in the tubular housing.

If desired the fill valve may include an attachment connected to said valve member, said attachment being adjustable to maintain said fill valve in a partially open position.

Preferably, said attachment comprises a spider having at least one leg which radiates outwardly from a hub, and a member which extends through said hub and engages said valve member, the arrangement being such that the opening of said fill valve may be adjusted by rotation of said member.

The present invention also provides a float collar provided with a fill valve in accordance with the invention and a float shoe provided with a fill valve in accordance with the invention.

For a better understanding of the present invention reference will now be made, by way of example, to the accompanying drawings, in which:

BRIEF DESCRIPTION OF THE DRAWINGS

FIG. 12 is a side cross-section view of a wellbore valve according to the present invention.

FIG. 13A is a side cross-section view of a valve member of the valve of FIG. 12.

FIG. 13B is a side view of the valve member of FIG. 13A.

FIG. 13C is a bottom view of the valve member of FIG. 13C.

FIG. 14A is a side cross-section view of a ball seat retainer sub according to the present invention.

FIG. 14B is a cross-section view along line 14B—14B of FIG. 14A.

FIG. 15A is a side cross-section view of a top member for a valve according to the present invention.

FIG. 15B is a top view of a top member of FIG. 15A.

FIG. 16A is a side cross-section view of a body of the valve of FIG. 12.

FIG. 16B is a bottom view of the body of FIG. 16A.

FIG. 17 is an end view of a valve seat member of the valve of FIG. 12.

FIG. 18 is a side cross-section view of a float apparatus according to the present invention.

DETAILED DESCRIPTION OF THE PREFERRED EMBODIMENTS

Figure 1:
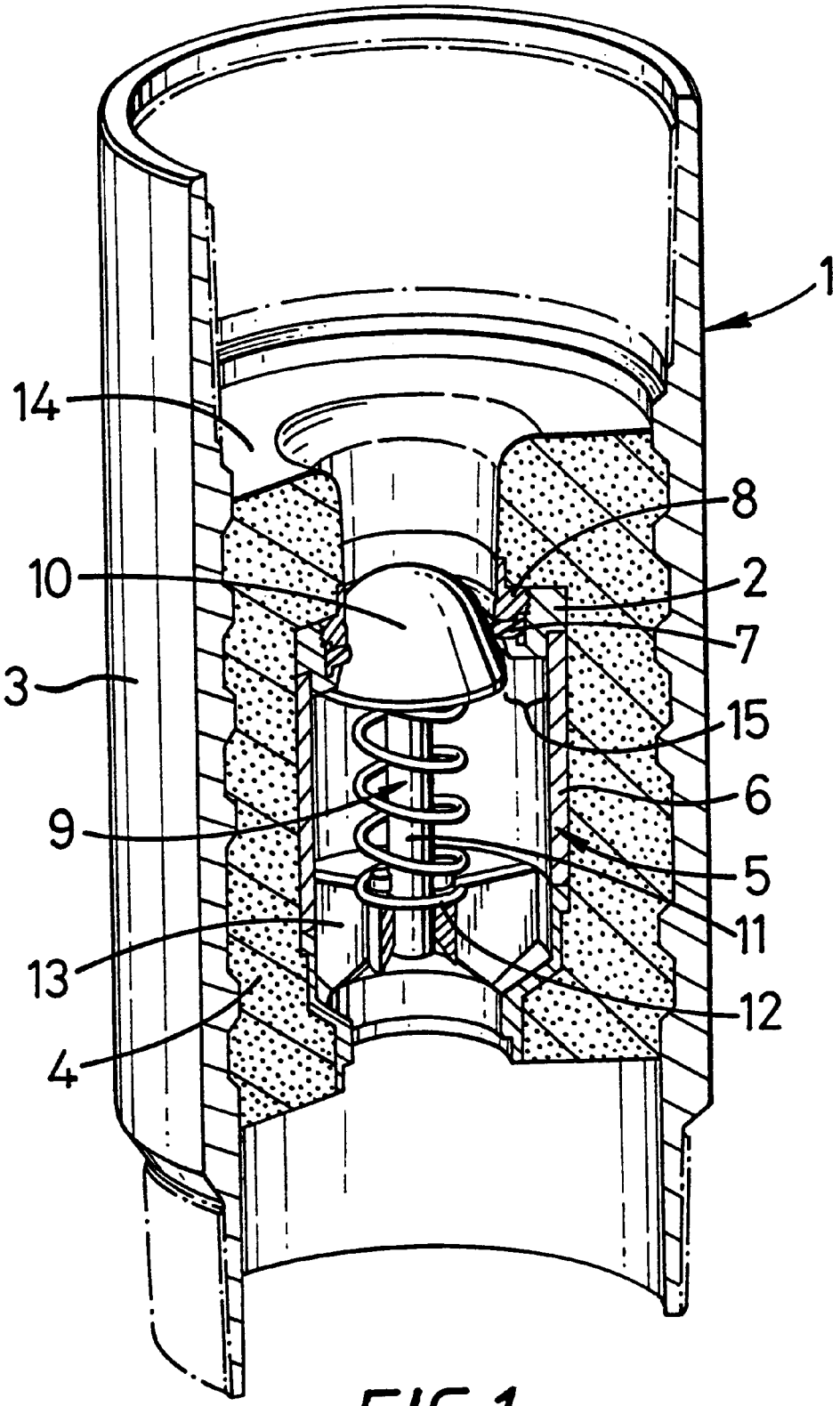
FIG. 1 PRIOR ART
FIG. 1 is a sectional view of one of the applicants float collars incorporating a known fill valve.

Referring to FIG. 1 of the drawings, there is shown one of applicants current float collars which is generally identified by reference numeral 1.

The float collar 1 comprises a fill valve 2 which is mounted in a short length of casing 3 by an annulus of high density cement 4.

The fill valve 2 comprises a tubular housing 5 including a cylindrical portion 6 and a valve set 7 supported by a plate 8.

A valve member 9 is accommodated in the tubular housing 5. The valve member 9 is mushroom shaped and comprises a head 10 and a stem 11.

The head 10 is biased against the valve seat 7 by a light spring 12 which is disposed circumjacent the stem 11 and acts between the head 10 and a spider 13.

In use, the float collar 1 is mounted in a length of casing towards the bottom thereof. Once the casing is in position mud is pumped down the casing 3. The mud flows through the fill valve 2 and then passes radially outwardly from the bottom of the casing 3 and upwardly through an annulus between the casing 3 and the wellbore. The mud carried debris to the surface. Typically mud is passed through the fill valve 2 for several hours. Conditioning fluid (usually referred to as "spacer) is then pumped down the casing. The conditioning fluid helps remove the mud and contains chemicals which help the cement adhere to the casing.

After conditioning a charge of cement is pumped down the casing between a top plug and a bottom plug in the conventional manner. After the bottom plug seats on the upper surface 14 of the float collar 1 increasing pressure is applied to the top plug until a bursting disk in the bottom plug ruptures and permits the cement to flow downwardly into the float collar 1. The pressure applied to the cement by the top plug is transmitted to the head 10 of the valve member 9 which moves downwardly away from valve seat 7 thereby permitting the cement to pass through the fill valve 2.

When the top plug contacts the bottom plug no further cement passes through the fill valve. Pressure is then released on the top plug, the fill valve acting to inhibit cement flowing upwardly inside the casing. After the cement has set the top plug, bottom plug, fill valve and any cement below the fill valve are drilled out.

The flow of conditioning fluid and cement through the fill valve 2 is limited by the flow area between the perimeter of the head 10 of the valve member 9 and the cylindrical portion 6 of the tubular housing 5, i.e the annulus having the width 15.

Figure 2:
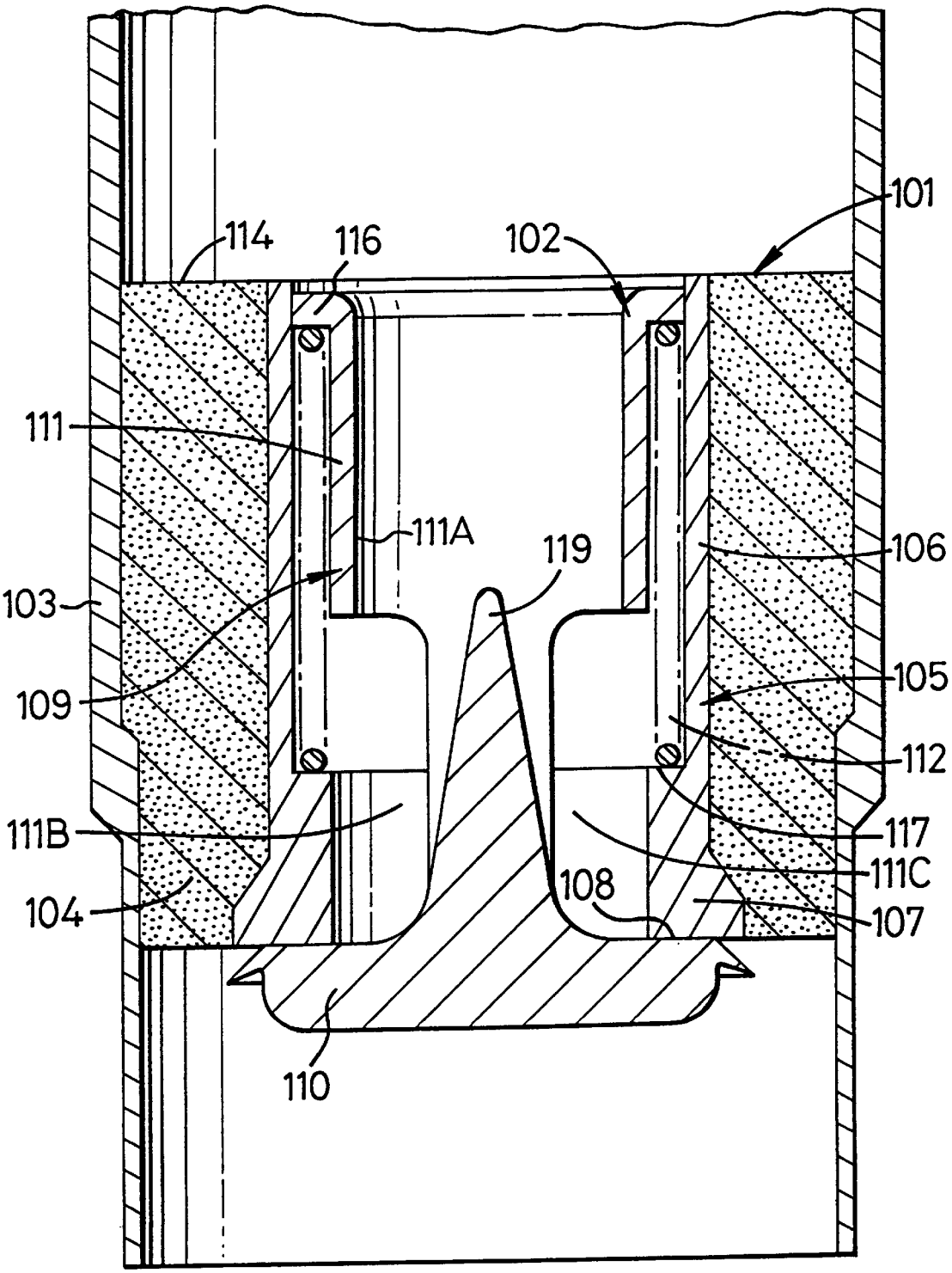
FIG. 2 is a cross-sectional view of one embodiment of a float collar incorporating a fill valve in accordance with the present invention in its closed position.
Figure 3:
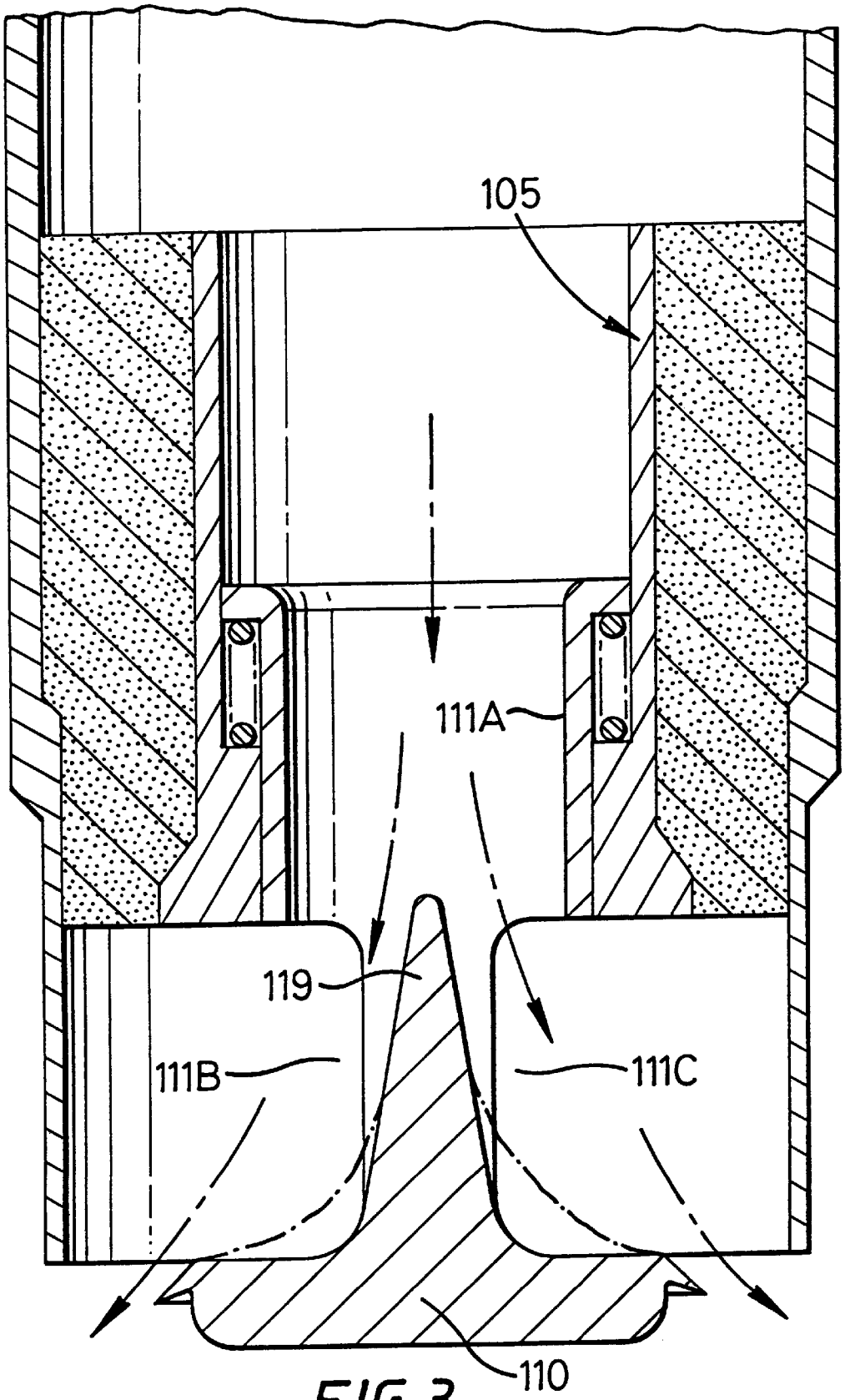
FIG. 3 is a view similar to FIG. 2 but showing the fill valve in its open position.

Referring now to FIGS. 2 and 3 of the drawings there is shown a float collar which is generally identified by reference number 101.

The float collar 101 comprises a fill valve 102 which is mounted in a short length of casing 103 by an annulus of high density cement 104.

The fill valve 102 comprises a tubular housing 105 including a cylindrical portion 106 and a valve seat 107 having a seating surface 108.

A valve member 109 is accommodated in the tubular housing 105. The valve member comprises a head 110 and a stem 111 which comprises a tubular portion 111A provided with windows 111B and 111C.

The head 110 is biased against the valve seat 107 by a light spring 112 which is disposed circumjacent the stem 111 and acts between a flange 116 on the top of the tubular portion 111A and a shoulder 117 formed in the tubular housing 105 between the cylindrical portion 106 and the valve seat 107.

In use the float collar 101 is mounted in a length of casing towards the bottom thereof. Once the casting is in position mud is pumped down the casing. The mud displaces the valve member 109 downwardly from valve seat 107 thereby permitting the mud to pass through the fill valve 102. The mud then passes downwardly to the bottom of the casing, radially outwardly and then upwardly in the annular space between the casing and the wellbore. The mud removes debris from the annular space and carries it to the surface. After several hours the flow of mud is stopped and conditioning fluid is pumped down the casing to prepare the annular for cementing.

After conditioning a charge of cement is pumped down the casing between a top plug and a bottom plug in the conventional manner. After the bottom plug seats on the upper surface 114 of the float collar 101 increasing pressure is applied to the top plug until a bursting disk in the bottom plug ruptures and permits the cement to flow downwardly into the float collar 101. The pressure applied to the cement by the top plug is transmitted to the head 110 of the valve member 109 which moves downwardly away from valve seat 107 thereby permitting the cement to pass through the fill valve 102.

As shown in FIG. 3 the cement passed through the tubular portion 111A and exits via windows 111B and 111C which are disposed opposite one another.

A deflector 119 is provided and extends upwardly from the head 110 into the tubular portion 111A. The deflector 119 guides the cement towards the windows 111B and 111C.

In a prototype the fill valve 102 shown in FIGS. 2 and 3 had a flow area significantly greater than the fill valve 2 shown in FIG. 1 although the inner diameter of the cylindrical portions 6 and 106 of each fill valve 2, 102 was substantially equal.

Figure 4:
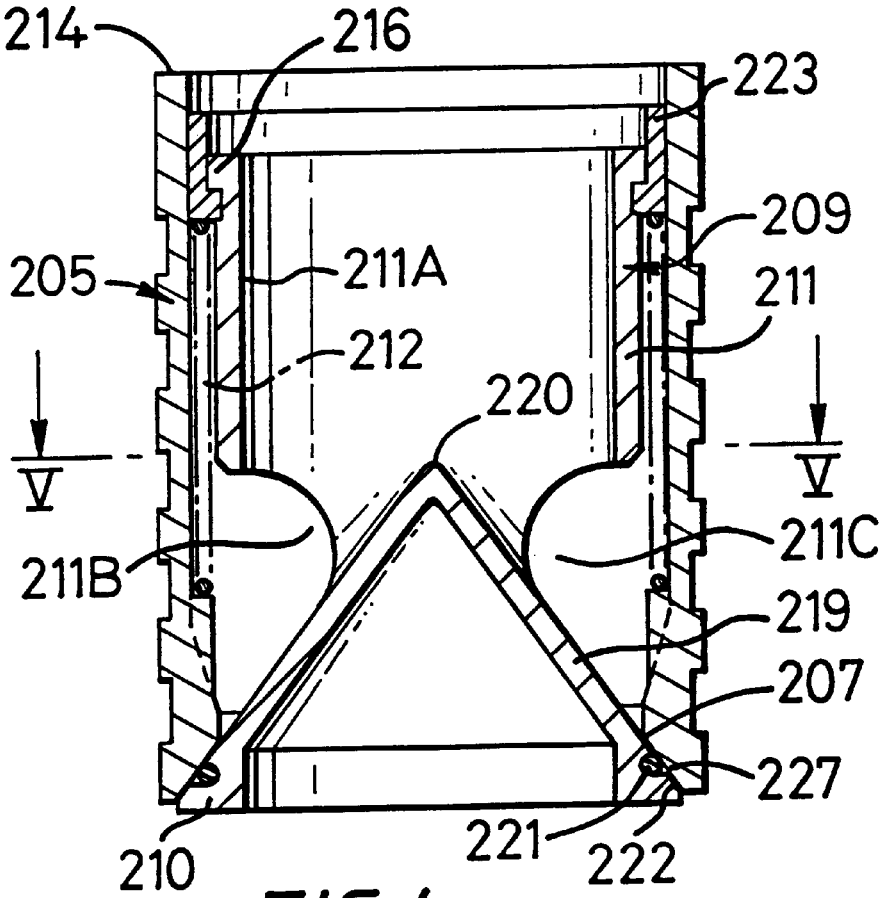
FIG. 4 is a sectional view of a second embodiment of a fill valve in accordance with the invention.
Figure 5:
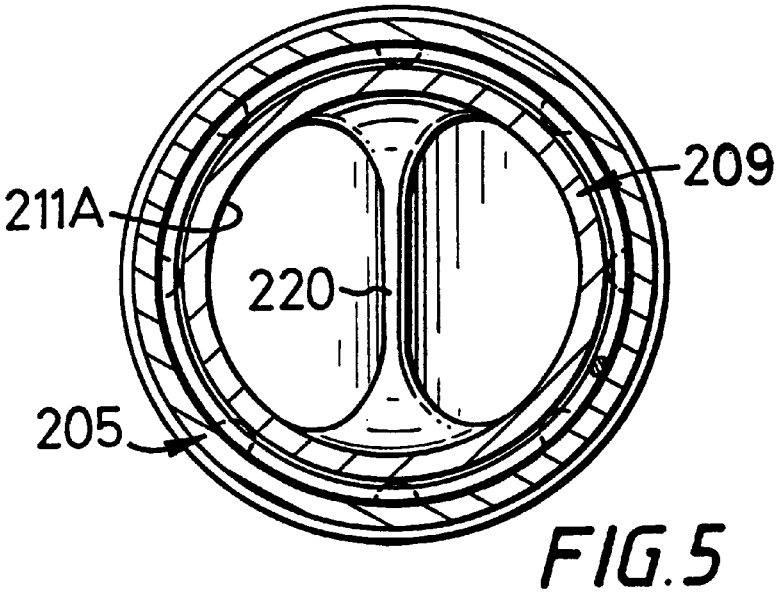
FIG. 5 is a view on line V—V of FIG. 4.

The embodiment show in FIGS. 4 and 5 generally similar to that show in FIGS. 2 and 3 with the exception that the deflector 219 is inclined uniformly from the inside of the valve seat 207 to an apex 220 on the centreline of the valve member 209. In addition the valve seat 207 is bevelled and is arranged to receive an O-ring seal 221 mounted on a correspondingly bevelled surface 222 of the head 210 of the valve member 209. A further difference is that a ring 223 is attached to the stem 211. The ring 223 is recessed below the upper surface 214 of the float collar to ensure that valve member 209 des not start to open as soon as the bottom plug engages the upper surface 214 of the float collar. This arrangement also ensures that the stem 211 can rise freely at the end of cementation to close the fill valve.

Figure 6:
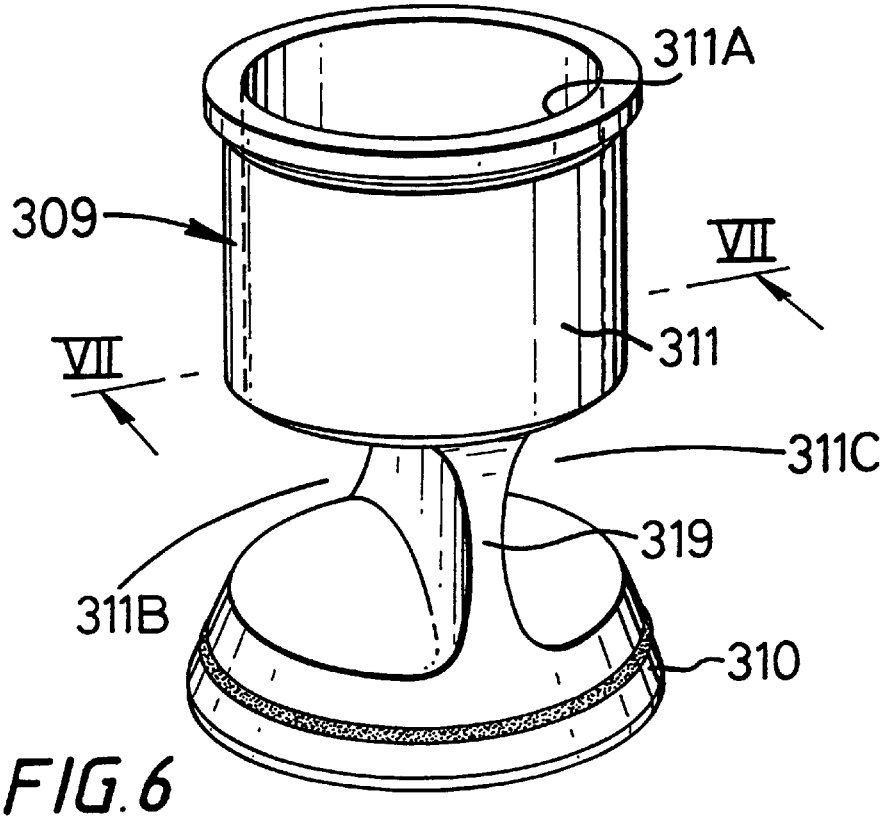
FIG. 6 is a perspective view of a valve member forming part of a third embodiment of a fill valve in accordance with the present invention.
Figure 7:
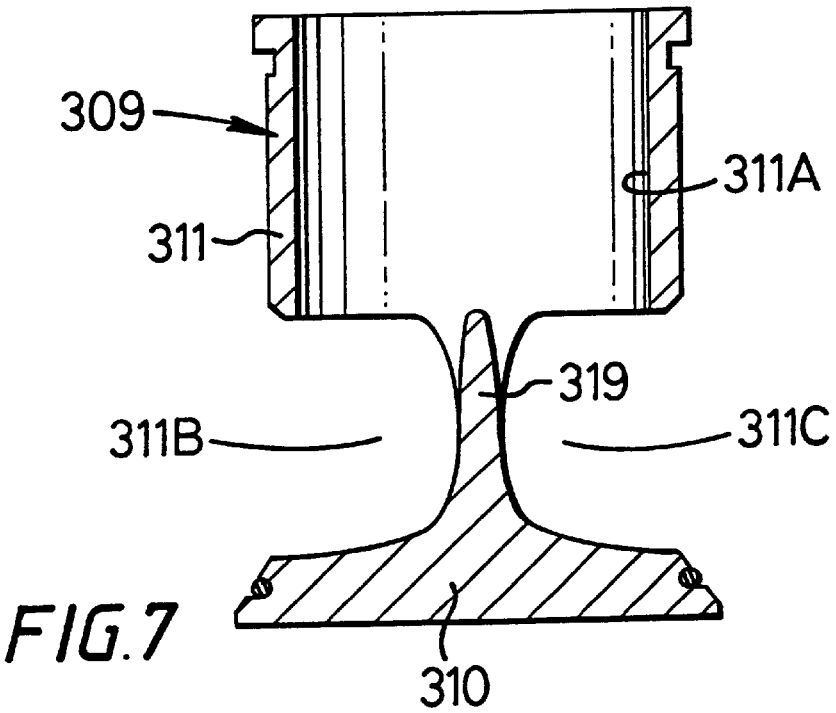
FIG. 7 is a view taken on line VII—VII of FIG. 6.

FIGS. 6 and 7 show a further embodiment using a relatively small deflector 319.

Figure 8:
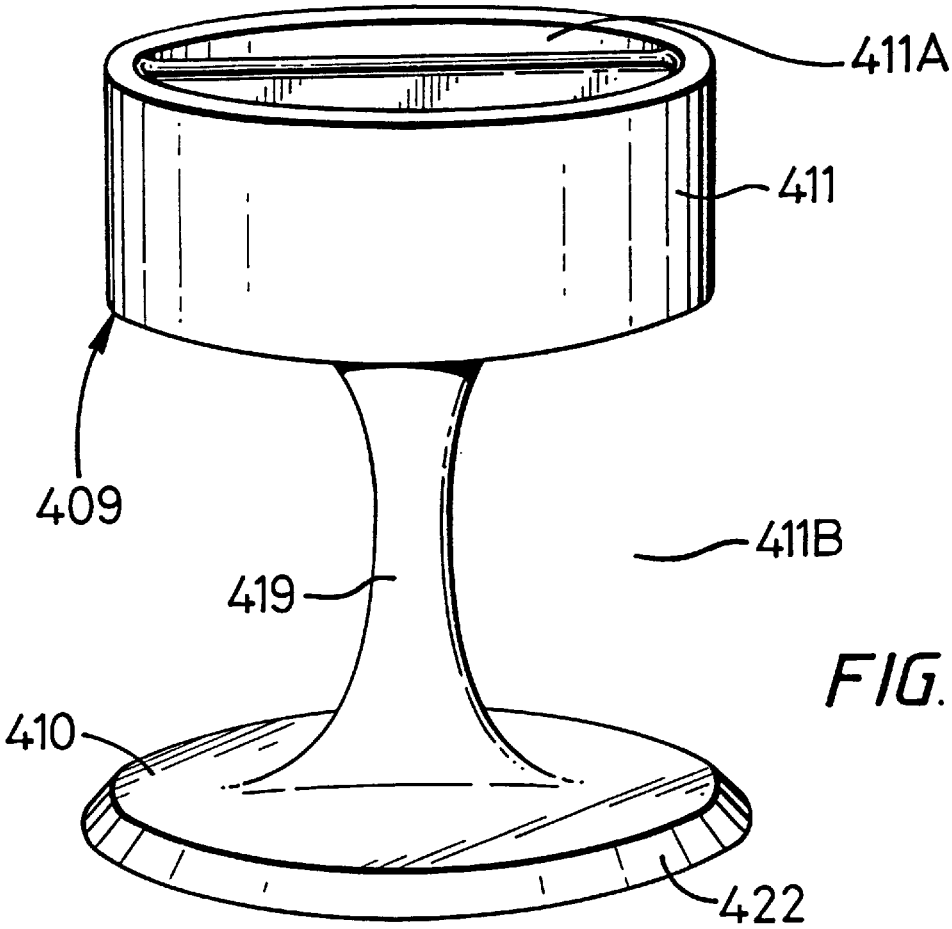
FIG. 8 is a perspective view of a valve member forming part of a fourth embodiment of a fill valve in accordance with the invention.
Figure 9:
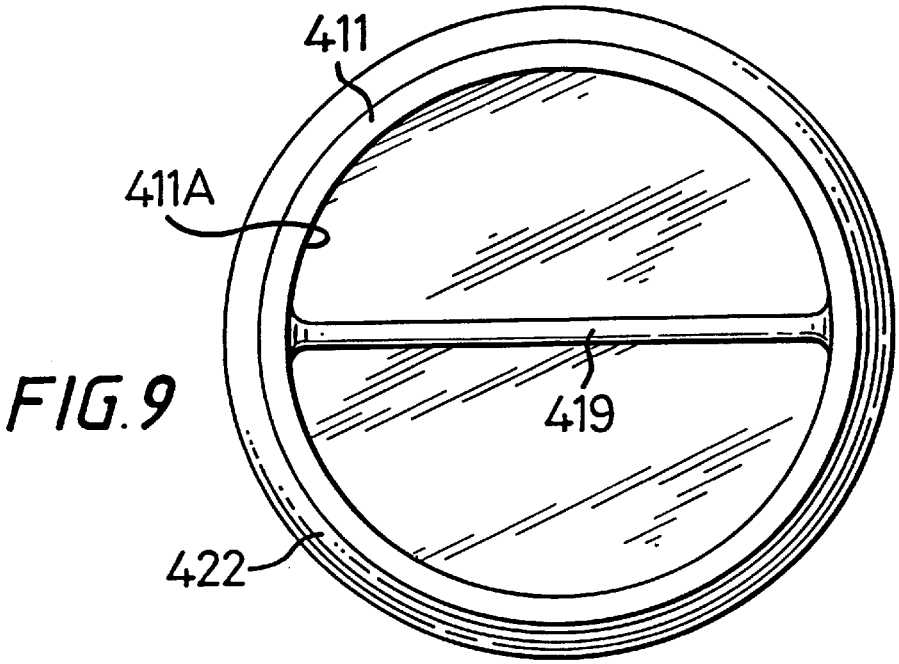
FIG. 9 is a top plan view of the valve member shown in FIG. 8.

FIGS. 8 and 9 show a valve member 409 which comprises a tubular portion 411A provided with a single window 411B. The head 410 has a bevelled surface 422 which, unlike the embodiment shown in FIGS. 4 and 5, is not provided with an O-ring seal. The head 410 is attached to the tubular portion 411A via deflector 419.

Figure 10:
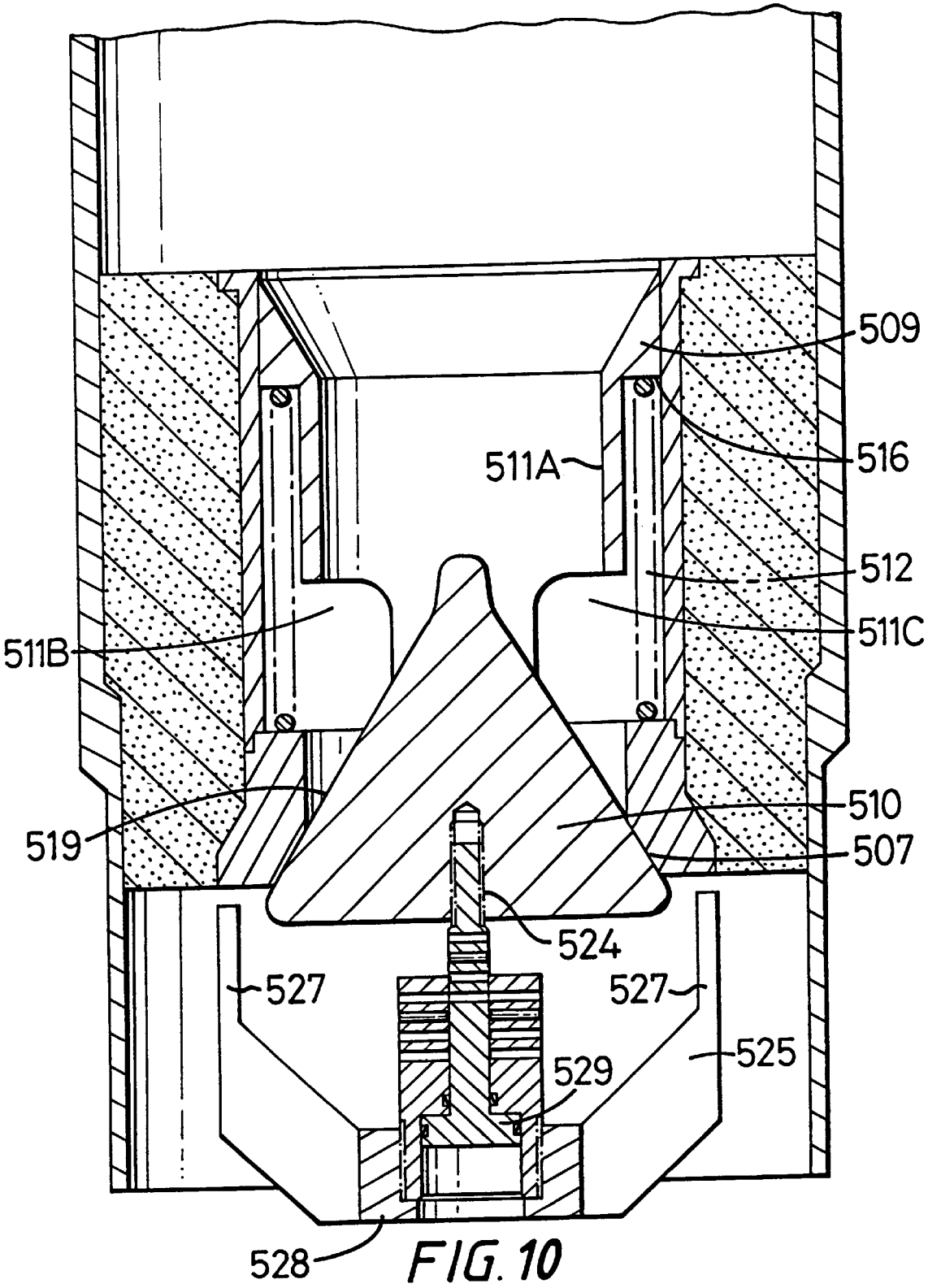
FIG. 10 is a vertical cross-section through a fifth embodiment of a fill value in accordance with the invention with an attachment in an inoperative position.
Figure 11:
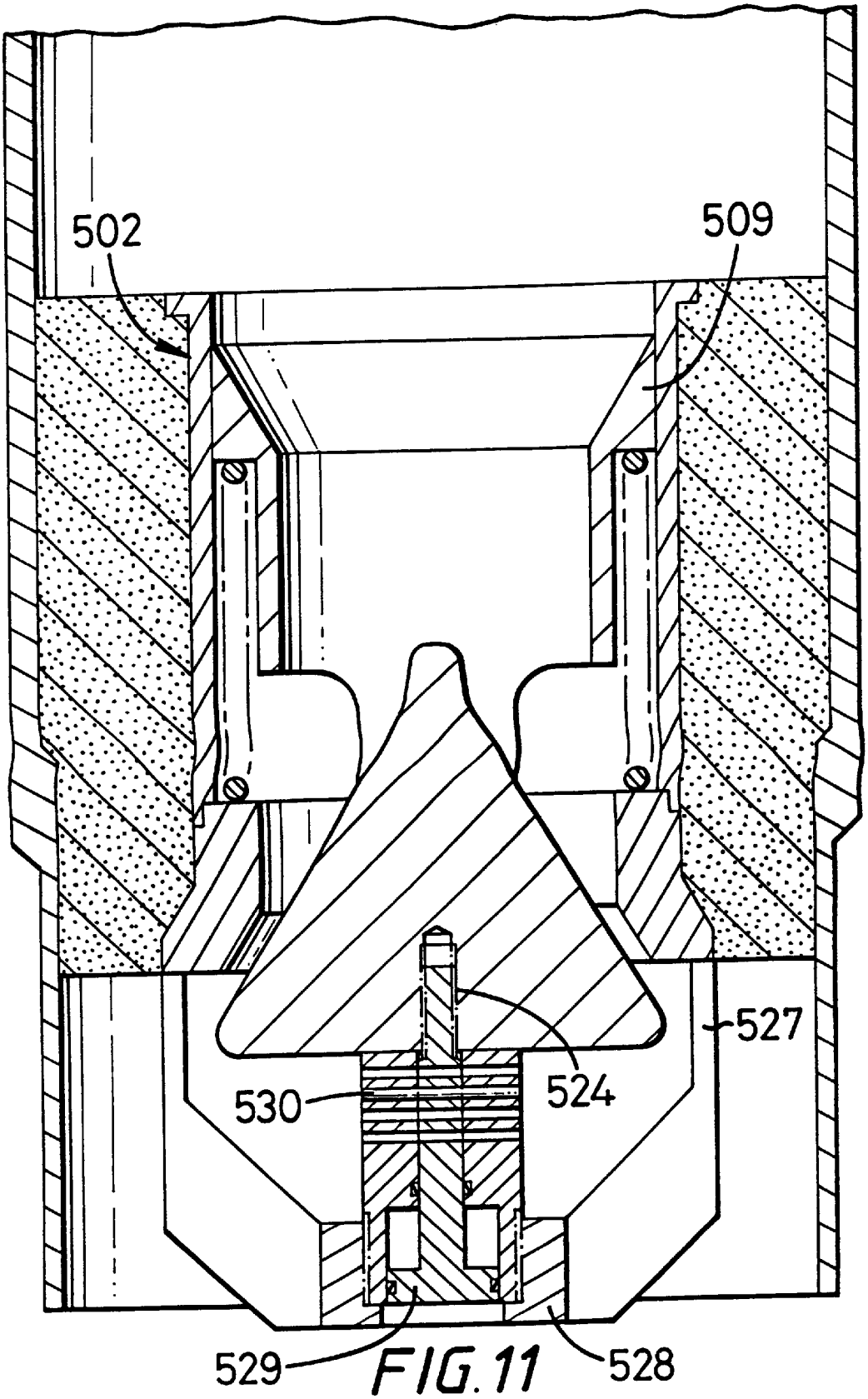
FIG. 11 is a view similar to FIG. 10 showing the fill valve with the attachment in an operative position.

In the embodiment shown in FIG. 10, the head 510 of the valve member 509 is provided with a threaded bore 524 into which is screwed an attachment 525. The attachment 525 comprises a spider having four legs 527 which radiate outwardly from a bug 528.

A bolt 529 extends through the hub 528 and is screwed into the threaded bore 524.

When lowering a string of casing into a wellbore it is sometimes desirable to be able to allow liquid from the wellbore to flow into the casing at a controlled rate. For this purpose a shear pin 520 is first inserted through a bore extending through the hub 528 and the bolt 529. The hub 529 is then rotated so that the bolt 529 enters the threaded bore 524. Rotation is continued until the attachment 525 bears against the valve seat 507 and the fill valve is opened by the desired amount.

In use, the valve member 509 is opened by the desired amount and the casing lowered down the wellbore. When the pressure on the bottom of the head 510 of the valve member 509 reaches a predetermined level the shear pin 530 breaks and the fill valve closes.

During a cementing operation the valve member 509 is displaced downwardly in the previously described manner to allow fluid to pass through the valve 502.

Various modifications to the embodiments described are envisaged. For example, whilst the preferred tubular portion is of circular cross-section it could also be polygonal; for example square, or oval although circular is much preferred. Whilst the head 210 of the valve member 209 shown in FIGS. 6 and 7 uses an O-ring seal 221 this may be omitted in certain circumstances. Alternatively, the head 210 may comprise a resilient sealing material.

Our most recent work indicates that the deflector should be shaped to inhibit turbulence in the fluid as it passes through the fill valve. This reduces cavitation which, in turn, reduces errosion and enhances the longevity of the fill valve.

Referring now to FIGS. 12–13C and 16A–17, a fill valve 600 according to the present invention has a body 602 with a fluid flow channel or bore 604 therethrough from one end to the other. A ridge 606 and valleys 608 on the exterior of the body 602 facilitate cementing of the body 602 in place in float equipment.

A valve member 620 with a fluid flow bore 622 is movably positioned in the body 602. A spring 640 with a top end biased against a shoulder 642 of the valve member 620 and a bottom end biasd against a plurality of fingers 612 projecting inwardly from the body 602 normally urges the valve member 620 upwardly so that a seal 632 around a seat member 630 is held in sealing contact with a bottom seat 610 of the body 602, thereby preventing fluid, etc. from flowing from below the valve 600 up through the bore 604.

Preferably in this embodiment the body 602 and valve member 620 are sized and configured so that a flow channel 646 is defined between the valve member 620 and the body 602. Fluid from above the valve 600 flows down into the channel 646 and past the spring 640 to dislodge debris and solids and clean the spring 640 and area therearound.

The valve member 620 has a fluid deflector 628 (like the previously described deflectors) and a plurality of windows 648 adjacent the deflector provide a fluid flow path for fluid flowing from about when the valve is open.

The valve seat member 630 is secured to the deflector 628, e.g. by known epoxy adhesives and by a stud 634 that has one end friction-fitted and/or glued in a recess 636 of the deflector 628 and one end on the bottom of the seat member 630. One or more feet 650 on the bottom of the seat member 630 prevent the seat member 630 from seating against another item disposed below the valve 600.

As shown in FIGS. 13A–13C a plurality of ribs 652 support the deflector 628. A fluid pressure equalization port 644 in fluid communication with chambers 646 in the ribs 652 prevent collapse of the hollow deflector 628 due to a hydrostatic head of fluid pressure to which the deflector 628 is subjected.

FIGS. 14A and 14B show a ball seat retainer sub 700 according to the present invention with a body 702, a fluid flow bore 704 from one end to the other, and a ball retainer 710. The ball retainer 710 has a body 712, a flexible rubber ball receiver 714 (through which a ball of desired size may be pumped) and a ball trap 716 (through which the ball may also be pumped). The ball retainer 710 is held in the body 702, e.g. by an amount of cement 706.

As shown in FIG. 14B, the ball trap 716 has a plurality of flow slots 718. If a ball B is pumped through the sub 700 and then fluid under pressure from the opposite direction pushes the ball upwardly, it encounters the ball trap 716 which prevents the ball from moving further upwardly and, simultaneously, lets fluid flow upwardly through the slots 718 since the ball does not block all the slots.

FIGS. 15A and 15B show an anti-rotation top member 730 with a body 732 and a fluid flow bore 734 for use with valves and float equipment as described herein (e.g. with the apparatus shown in FIG. 18). The body 732 is molded with a plurality of indentations or channels 736 (or they are formed therethrough by drilling or milling) which are sized, positioned and configured to anti-rotatively receive a corresponding nose of another device, e.g. a plug. The channels 736 may extend through the body 732 as shown or may terminate within the body 732.

FIG. 18, left side, shows a float collar 800 according to the present invention with a body 802 having a lower threaded end 806, a bore 804, a valve 600 as previously described (but with a body 692), and an anti-rotative top member 730.

FIG. 18, right side, shows a float collar 850 according to the present invention with a body 852, a bore 854, a lower end 856, a valve 600 as previously described, and an anti-rotative top member 730.

A ball set retainer sub like the sub 700 may be used above a float collar according to this invention, e.g. one or more joints above a float collar.

In a typical operation of apparatus as shown in FIGS. 12–18, the bottom of a string is connected to a joint which is in turn connected to a float collar (each with a valve like the valve 600). The casing string (plurality of hollow pieces of casing joined end-to-end) is then run to the bottom of the wellbore. Typically circulation in a wellbore is done prior to cementing the casing in place to insure the annulus is clean, e.g. until mud at the bottom of the wellbore has been circulated to the surface. Then a spacer fluid is pumped down the casing, a bottom plug is launched, cement is pumped down, a top plug is pumped down, and the bottom plug lands on the float collar. At a sufficient pressure, a disc or diaphragm in the bottom plug bursts and the cement flows from the casing up into the annulus. When the top plug lands on the bottom plug, cement flow ceases. The valve(s) 600 prevent flow back into the casing, e.g. u-tubing, when the cement weighs more than the fluid used to displace the top plug.

In another embodiment the valve body 602 has an upper shoulder and the valve member 620 has two shoulders so that two springs urge the valve normally closed; one spring, an upper spring biased against a top shoulder of the valve member and the shoulder of the valve body; and the second spring, a lower spring, biased against a lower shoulder of the valve member and the fingers of the valve body.

Figure 19:
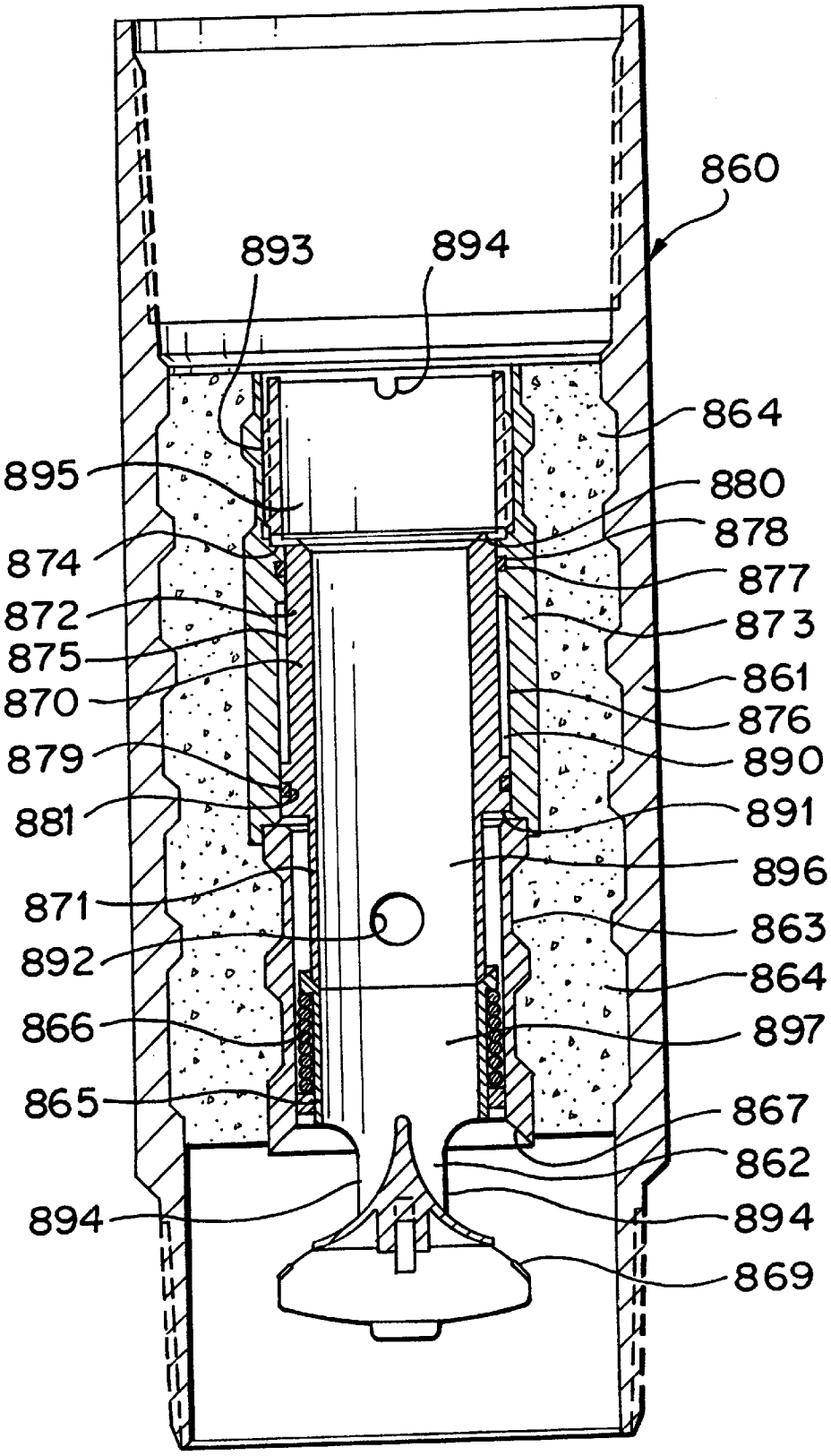
FIG. 19 is a side cross-section view of a float apparatus according to the present invention.

FIG. 19 shows a float collar 860 according to the present invention which has a fill valve 862 mounted partially in an amount of cement 864 in a tubular 861 (e.g., but not limited to, a piece of casing). The fill valve 862 has a housing 863 in which is movably mounted to a valve member 865 (similar to those of FIGS. 12 and 18). A spring 866 biases the valve member 865 upwardly, and, upon freeing of the valve member, moves it to a valve closed position. The housing 863 has a valve seat surface 867 against which a portion 869 of the valve member 865 may seat to close off fluid flow through the float collar 860.

A slider 870 has a lower end 871 initially positioned in the upper part of the housing 863 and an upper end 872 initially extending through a slider housing 873 and abutting a shear ring 880. The slider housing 873 is secured in the cement 864. The shear ring 880 is held in place on a ledge 874 of the housing slider 873 by an insert 894 that has a threaded exerior that threadedly mates with a threaded interior 893 of the top of the slider housing 873. Movement of the slider 879 is initially prevented by its abutment against the shear ring 880. Fluid flows, when the valve 862 is open, through a central flow bore 895 of the insert 894, through a central flow bore 896 of the slider housing 873; then through the central flow bore 897 of the valve member 865 and out openings or windows 894 (as described for the apparatuses of, e.g, FIGS. 2 and 12).

A sealed chamber 890 is defined by an exterior surface 875 of the slider 870 and an interior surface 876 of the slider housing 873. A top o-ring 877 in a recess 878 in the slider housing 873 and a bottom o-ring 879 in a recess 881 in the slider 870 seal the chamber 890. Fluid (e.g., gas, e.g., helium, nitrogen, air) at a desired pressure is captured in the chamber 890 during its assembly at the surface. In an alternate embodiment, a valved port in communication with the chamber allows the selective introduction of fluid into the chamber and evacuation therefrom. In one aspect the fluid is air at atmospheric pressure. During operation of the float collar 860 in a wellbore in which there is wellbore fluid (cement, mud, etc.) with a hydrostatic head of pressure, the pressure of the hydrostatic head at some point exceeds the pressure of fluid in the chamber 890 and the slider then begins to exert force on the shear ring 880. When this force exceeds the rating of the shear ring (e.g., but not limited to, 1000, 2000, 3000, 4000, 5000, or more psi strength), the slider 870 breaks the shear ring 880 freeing the valve member 865 for movement to close the valve 862 thereby preventing fluid flow through the float collar 860 (unless and if the spring force is overcome by pumping fluid on top of the valve member at sufficient pressure).

The slider 870 acts as a piston as the head pressure acts on it, including on the surfaces 891. This piston effect (due to differential area) is achieved due to the smaller diameter at the interior of the o-ring 877 compared to the larger diameter at the outer surface of the O-ring 879.

The hole 892 (one or more may be used) provide a flow path for fluid to flow to the surfaces 891 and prevent an hydraulic lock between the moving parts.

The slider/shear ring mechanism described above may, according to this invention, be used with: any known float valve; any float valve described herein; any known float collar; or any float collar described herein. The float collar of FIG. 19 is used generally as are the other float collars described herein, as is the valve of the collar of FIG. 18.

FIG. 20 shows a fill valve 1500 according to the present invention which is like the fill valve in FIG. 10 of U.S. Pat. No. 5,450,903 and in U.S. application Ser. No. 08/639,886 (both co-owned with the present invention and incorporated here in their entirety), but with a recess 1530 encircling a head 1510 and opening adjacent a valve seat 1507. In one aspect, the head 1510 is made of resilient material (e.g. somewhat flexible rubber, plastic, polyurethane, etc. that permits some flexing so that a lower portion of the head 1510 subjected to fluid pressure may flex due to the presence of the recess 1530 to enhance the sealing effect of the head 1510 against the valve seat 1507. In another aspect the head 1510 is rigid (e.g. made of rigid plastic, metal, e.g. stainless steel, e.g. SS316) and the recess or recesses 1530 are used to hold debris that might otherwise inhibit proper and complete seating of the valve member against the valve seat. The head 1510 of a valve member 1509 is provided with a threaded bore 1524 into which is screwed an attachment 525. The attachment 1525 comprises spider having four legs 1527 which radiate outwardly from a hub 1528. A bolt 1529 extends through the hub 1528 and is screwed into the threaded bore 1524. When lowering a string of casing into a wellbore it is sometimes desirable to be able to allow liquid from the wellbore to flow into the casing at a controlled rate. For this purpose a shear pin 1530 is first inserted through a bore extending through the hub 1528 and the bolt 1529. The hub 1528 is then rotated so that the bolt 1529 enters the threaded bore 1524. Rotation is continued until the attachment 1525 bears against the valve seat 1507 and the fill valve is opened by the desired amount. Fluid flows through windows 1511B and 1511C in a tubular portion 1511A of the valve member 1509. A spring 1512 abuts a top flange 1516 and a top of the valve seat 1507. In use, the valve member 1509 is opened by the desired amount and the casing lowered down the wellbore. When the pressure on the bottom of the head 1510 of the valve member 1509 reaches a predetermined level the shear pin 1530 breaks and the fill valve closes.

During a cementing operation the valve member 1509 is displaced downwardly in the previously described manner to allow fluid to pass through the valve 1502.

It is within the scope of this invention to use one or more recesses 1530 on any valve member disclosed in U.S. Pat. No. 5,450,903, on any valve as in FIG. 19, or on any known valve member of any valve used in any wellbore operations or of any known float or fill valve.

Figure 20A:
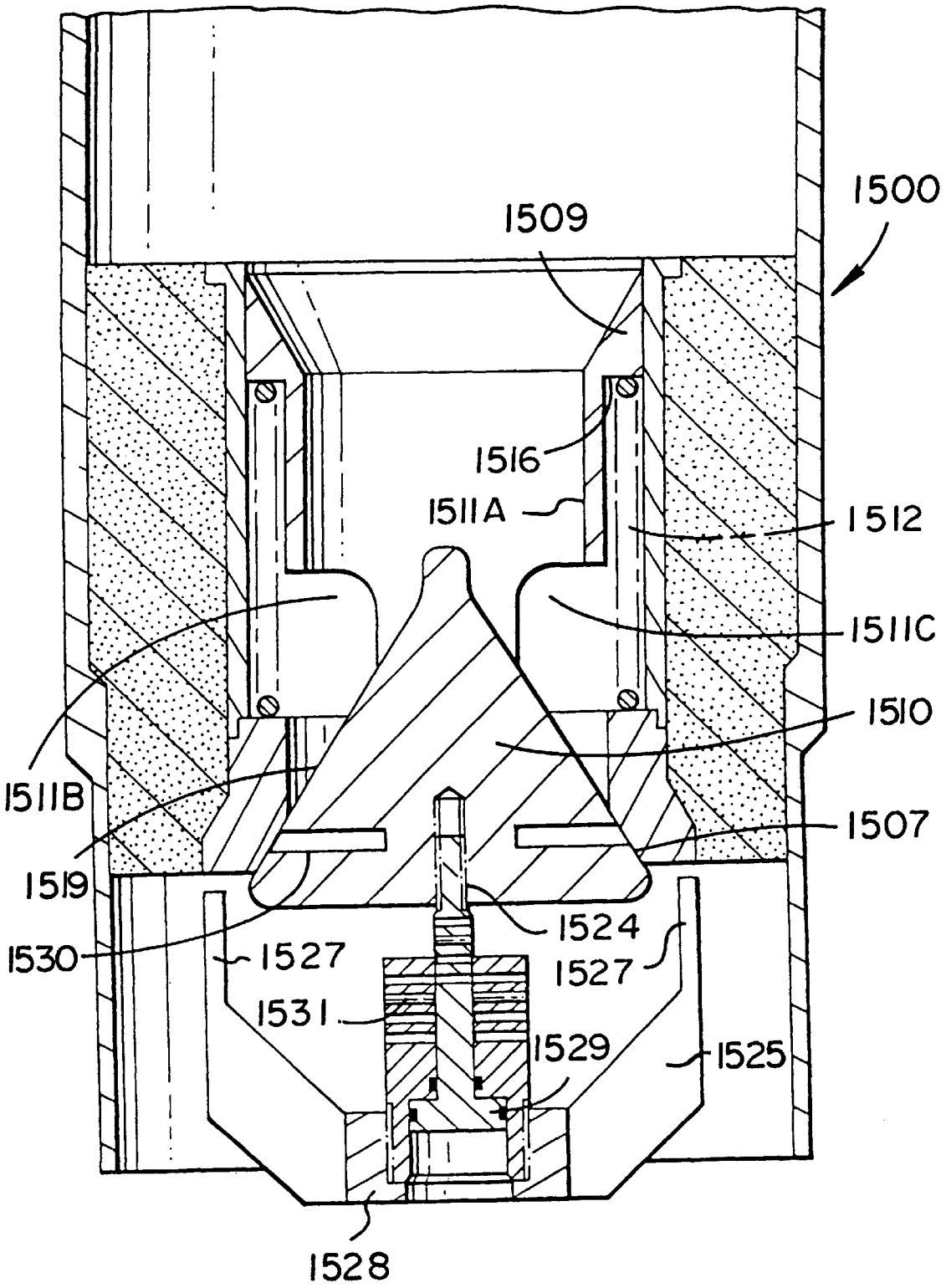
FIG. 20A is a side cross-section view of a valve according to the present invention.
Figure 20B:
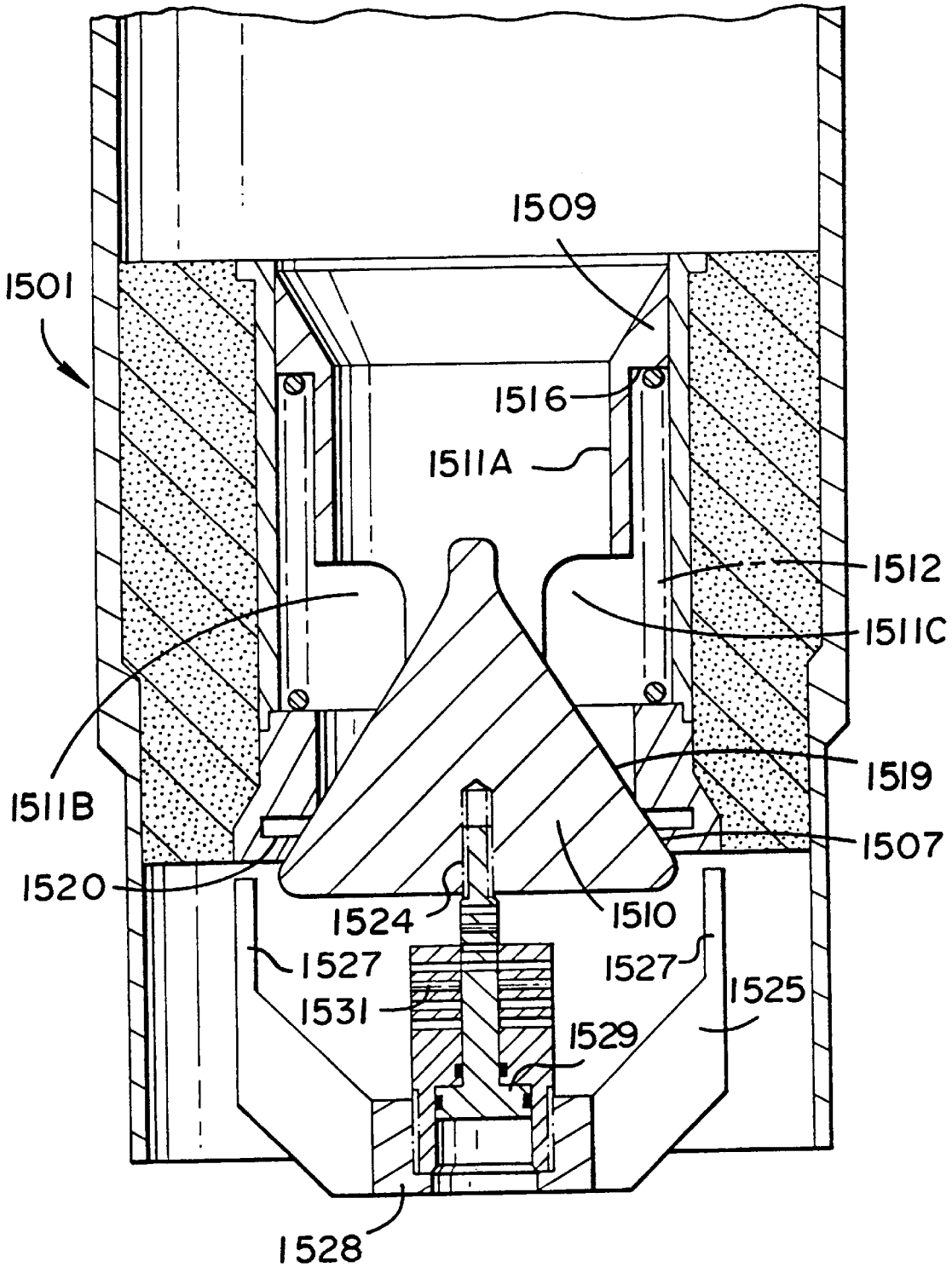
FIG. 20B is a side cross-section view of a valve according to the present invention.

FIG. 20B shows a float valve 1501 like the float valve 1500, FIG. 20A (and the same numerals denote the same parts), but without the recess 1530. The valve seat 1507 does have a recess encircling it for holding debris and/or for facilitating sealing in a manner similar to that in which the recess 1530 operates. Fluid pressure on the head 1510 pushes it against the valve seat 1507 and parts of the valve seat 1507 flex in response to the pressure due to the presence of the recess 1520. The seat 1507, in one aspect, is made of suitable material (e.g. but not limited to plastic or polyurethane) to allow flexing of its lower portion. The slider/shear ring mechanism of the collar of FIG. 19 may be used with the valves of FIGS. 20A and 20B instead of or in addition to the shear pin apparatus used therein. It is also within the scope of this invention for the fluid chamber 890 to be located at any place on the slider or for the slider as a separate piece to be deleted and the chamber defined between surfaces of the valve member itself with suitable O-rings and corresponding O-ring recesses or other seal members.

Therefore, the present invention, in certain embodiment, discloses a fill valve for use in cementing operations in a wellbore extending down into the earth, the fill valve having a tubular housing having a valve seat, a valve member slidably mounted in said tubular housing, spring for biasing said valve member towards a closed position, said valve member comprising a head engageable with said valve seat of said tubular housing to close the valve, selectively releasable apparatus for releasably maintaining the fill valve in an open position, and the selectively releasable apparatus including a shear ring breakable in response to pressure thereon, a slider movably disposed in a slider housing mounted in the tubular housing, a lower end of the slider initially projecting down and out from the slider housing and abutting a top end of the valve member and preventing the valve member from moving, a top end of the slider abutting the shear ring, the slider prevented initially from moving by the shear ring, the slider movable in response to pressure of fluid in the wellbore; such a fill valve including a tubular portion and at least one window in said tubular portion so that fluid pumped through said tubular portion displaces said valve member relative to said tubular housing to open the fill valve and exit via said at least one window; any such fill valve with a sealed gas chamber between an exterior of the slider and an interior of the slider housing, the sealed gas chamber sealed at the top by a top O-ring in a recess in the slider housing, the top O-ring sealingly contacting an exterior surface of the slier, the sealed gas chamber at the bottom by a bottom O-ring in a recess in the slider, the bottom O-ring sealingly contacting an interior surface of the slider housing; any such fill valve wherein the top O-ring has an inner diameter and the bottom O-ring has an outer diameter greater than the inner diameter of the top O-ring.

The present invention, in certain embodiments, discloses a casing string with a plurality of hollow tubular pieces of casing connected end-to-end, a fill valve connected to a lowermost end of the lowermost casing, the fill valve being any fill valve s disclosed herein and/or as described in the preceding paragraph. The present invention also discloses methods for using such a casing string and/or such fill valves.

The present invention, in certain embodiments, discloses a ball seat retainer sub for use in wellbore operations, the ball seat retainer sub having a hollow body member with a fluid flow bore therethrough, a ball seat retainer secured in the fluid flow bore of the hollow body member, the ball seat retainer having a flexible retainer body and a ball trap mounted therein, the ball trap having a plurality of slots therethrough, the flexible retainer body having an opening therethrough closable by a ball and through which the ball is pumpable, and the ball pumpable through the ball trap, the ball trap preventing subsequent upward passage of the ball therethrough while permitting fluid flow through the ball seat retainer sub.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in 517 102. The invention claimed herein is not obvious in accordance with 35 U.S.C. § 103 and satisfies the conditions for patentability in § 103. This specification and the claims that follow are in accordance with all of the requirements of 35 U.S.C. § 112.

We claim:

1. A fill valve for use in cementing operations in a wellbore extending down into the earth, the fill vale comprising a tubular housing having a valve seat, a valve member slidably mounted in said tubular housing, spring means for biasing said valve member towards a closed position, said valve member comprising a head engageable with said valve seat of said tubular housing to close the valve, selectively releasable apparatus for releasably maintaining the fill valve in an open position, and the selectively releasable apparatus including a shear ring breakable in response to force thereon, a slider movably disposed in a slider housing mounted in the tubular housing and movable to exert force on the shear ring to break the shear ring, a lower end of the slider initially projecting down and out from the slider housing and abutting a top end of the valve member and preventing the valve member from moving, a top end of the slider abutting the shear ring, the slider prevented initially move moving by the shear ring, the slider movable in response to a hydrostatic head pressure of fluid in the wellbore imposing an upward force on the valve member.

2. The fill valve of claim 1 further comprising the valve member including a tubular portion and at least one window in said tubular portion so that fluid pumped through said tubular portion displaces said valve member relative to said tubular housing to open the fill valve and exit via said at least one window.

3. The fill valve of claim 1 further comprising a sealed gas chamber between an exterior of the slider and an interior of the slider housing, the sealed gas chamber containing gas and sealed at the top by a top O-ring in a recess in the slider housing, the top O-ring sealingly contacting an exterior surface of the slider, the sealed gas chamber sealed at the bottom by a bottom O-ring in a recess in the slider, the bottom O-ring sealingly contacting an interior surface of the slider housing, the gas in the sealed gas chamber inhibiting upward movement of the slider.

4. The fill valve of claim 3 wherein the top O-ring has an inner diameter and the bottom O-ring has an outer diameter greater than the inner diameter of the top O-ring.

5. A casing string comprising a plurality of hollow tubular pieces of casing connected end-to-end, a fill valve connected to a lowermost end of the lowermost casing, fill valve comprising a fill valve for use in cementing operations in the construction of oil and gas wells, the fill valve comprising a tubular housing having a valve seat, a valve member slidably mounted in said tubular housing, spring means for biasing said valve member towards a closed position, said valve member comprising a head engageable with said valve seat of said tubular housing to close the valve, selectively releasable apparatus for releasably maintaining the fill valve in an open position, and the selectively releasable apparatus including a shear ring breakable member shearable in response to force thereon, a slider movably disposed in a slider housing mounted in the tubular housing and movable to exert force on the shear ring to break the shear ring, a lower end of the slider initially projecting down and out from the slider housing and abutting a top end of the valve member and preventing the valve member from moving, a top end of the slider abutting the shear ring, the slider prevented initially from moving by the shear ring, the slider movable in response to a hydrostatic head pressure of fluid in the wellbore imposing an upward force on the valve member.

6. The casing string of claim 5 wherein the valve member includes a tubular portion and at least one window in said tubular portion so that fluid pumped through said tubular portion displaces said valve member relative to said tubular housing to open the fill valve and exit via said at least one window.

7. A method for lowering a string of casing into a wellbore while allowing fluid in the wellbore to flow into the casing, the method comprising lowering a casing string into the wellbore, the casing string comprising a plurality of hollow tubular pieces of casing connected end-to-end, a fill valve connected to a lowermost end of the lowermost casing, the fill valve comprising a tubular housing having a valve seat, a valve member slidably mounted in said tubular housing, spring means for biasing said valve member towards a closed position, said valve member comprising a head engageable with said valve seat of said tubular housing to close the valve, selectively releasable apparatus for releasably maintaining the fill valve in an open position, and the selectively releasably maintaining the fill valve in an open position, and the selectively releasable apparatus including a shear ring breakable in response to force thereon, a slider movably disposed in a slider housing mounted in the tubular housing and movable to exert force on the shear ring to break the shear ring, a lower end of the slider initially projecting down and out from the slider housing and abutting a top end of the valve member and preventing the valve member from moving, a top end of the slider abutting the shear ring, the slider prevented initially from moving by the shear ring, the slider movable in response to a hydrostatic head pressure of fluid in the wellbore imposing an upward force on the valve member, liquid in the wellbore flowing into the string of casing through the open fill valve, and activating the selectively releasable apparatus to close the fill valve by shearing the shear ring by pressure of the fluid on the slider.

8. The method of claim 7 wherein the valve member of the fill valve includes a tubular portion and at least one window in said tubular portion so that fluid pumped through said tubular portion displaces said valve member relative to said tubular housing to open the fill valve and exit via said at least one window.

9. The method of claim 7 further comprising flowing cement down the casing string to open the fill valve so cement flows up into an annular space between an exterior surface of the casing string and an interior surface of the wellbore.

* * * * *